US012422224B2

(12) United States Patent
Uhr

(10) Patent No.: US 12,422,224 B2
(45) Date of Patent: Sep. 23, 2025

(54) SHOOTING SIMULATION DEVICE FOR PNEUMATIC GUNS

(71) Applicants: LASER AMMO LTD., Rishon le Zion (IL); LASER AMMO USA INC., Great Neck, NY (US)

(72) Inventor: Oren Louis Uhr, Rishon le Zion (IL)

(73) Assignee: LASER AMMO LTD., Rishon le Zion (IL)

( * ) Notice: Subject to any disclaimer, the term of this patent is extended or adjusted under 35 U.S.C. 154(b) by 827 days.

(21) Appl. No.: 17/569,579

(22) Filed: Jan. 6, 2022

(65) Prior Publication Data

US 2023/0213313 A1 Jul. 6, 2023

(51) Int. Cl.
*F41G 3/26* (2006.01)
*F41B 11/80* (2013.01)

(52) U.S. Cl.
CPC ..... *F41G 3/2655* (2013.01); *F41B 11/80* (2013.01)

(58) Field of Classification Search
CPC ..... F41G 3/2655; F41B 11/60
See application file for complete search history.

(56) References Cited

U.S. PATENT DOCUMENTS

| | | | | |
|---|---|---|---|---|
| 8,568,143 | B2 | 10/2013 | Uhr | |
| 8,734,156 | B2 | 5/2014 | Uhr | |
| 9,303,960 | B2 | 4/2016 | Uhr | |
| 2003/0003424 | A1* | 1/2003 | Shechter | F41A 33/02 434/21 |
| 2011/0281243 | A1* | 11/2011 | Uhr | F41A 33/00 434/11 |
| 2013/0273504 | A1* | 10/2013 | Carter | F41G 3/26 434/19 |
| 2013/0319216 | A1* | 12/2013 | Poirier | F41A 21/32 42/114 |

* cited by examiner

*Primary Examiner* — David L Lewis
*Assistant Examiner* — Shauna-Kay Hall
(74) *Attorney, Agent, or Firm* — Dilworth & Barrese, LLP.; Michael J. Musella, Esq.

(57) ABSTRACT

A shooting simulation device for pneumatic guns, including a housing having a proximal end attachable to or formed integrally with an end of a barrel of a gun, a piston having a head and a shaft, the head being slidable within the proximal end of the housing between a ready position and a firing position, and the shaft configured to extend into the end of the barrel of the gun, an illuminator in the housing, and an input device in the housing for activating the illuminator in response to an impact from the head of the piston in the firing position.

20 Claims, 13 Drawing Sheets

SHOOTING SIMULATION DEVICE FOR PNEUMATIC GUNS

FIELD OF THE INVENTION

The present disclosure relates generally to firearm simulation, and more particularly, to a device and system for simulating shots for pneumatic guns.

BACKGROUND

Live fire with firearms necessitates the expense of ammunition and a facility or range suitable for live fire. Dry firing—repeated drawing, aiming, and firing a firearm without ammunition—is a practical and convenient way to improve and/or maintain shooting techniques. However, dry firing lacks the mechanical upset of a firearm when shot, known as recoil, does not "cycle" semi-automatic and/or automatic firearms, and is limited by the fact that the considered bullet impact point is a mere assumption; thus, the users are limited in their ability to evaluate their performance or/and improve their skills.

U.S. Pat. No. 8,734,156 describes a dry fire training device to be inserted into the chamber of a firearm including an illuminator that illuminates in response to the activation of a firearm trigger. In particular, the dry fire device includes a firing pad that is impacted by the striker of the firearm to activate the illuminator. U.S. Pat. No. 8,568,143 describes a training barrel configured for use with a blank cartridge and a light emitting training cartridge to simulate live fire training. U.S. Pat. Nos. 8,734,156 and 8,568,143 are incorporated herein by reference.

Such devices may be used with target systems that register "hits" during simulated exercises, training, or gaming. The terms "exercises," "training," and "gaming," and their derivatives, are used interchangeably herein. An electronic target for use with a pulsed beam of laser light is described in U.S. Pat. No. 9,303,960, which is incorporated herein by reference. Electronic targets allow for non-live fire training (drawing, aiming, and firing without ammunition) in a practical, convenient manner to improve and/or maintain shooting techniques.

Traditional firearms can be modified to simulate the recoil action without live fire by using blank cartridges. Also well known in the industry are conversion kits which are a compressed gas activated recoil system for semi-automatic and/or automatic firearms. These systems utilize compressed $CO_2$ or other gas to simulate recoil by acting on the firearm's bolt and/or slide to "cycle" the gun. In addition to traditional firearms, there are also pneumatic (gas- or air-powered) or electric guns which are often referred to in the industry as "Air" or "Airsoft" or "BB" or "Gel" or "pellet" guns. These guns generally shoot spherical projectiles such as plastic or metal pellets using compressed gas. All the examples above are referred to herein as pneumatic guns. U.S. Pat. No. 8,568,143 indicates that the training barrel disclosed therein may be implemented for use in a pneumatic gun or toy in which the pneumatic gun or toy creates (or supplies) the increase in barrel pressure and/or irrupt movement to actuate the light emitting device.

However, activating a light emitting device in pneumatic guns using only the irrupt movement of the barrel has drawbacks. Generally, the light emitting device must be sufficiently sensitive to be activated by the irrupt movement alone. This sensitivity can lead to inadvertent activations of the illumination device when the gun is been handled.

There is a need for improved devices for simulating live gun fire for training and gaming, and particularly for pneumatic guns. The present invention solves these and other problems in the prior art.

SUMMARY

An object of the present invention is to provide an improved firearms training device for pneumatic guns that accurately and reliably responds to trigger pulls without being subjected to inadvertent activations.

In one exemplary embodiment according to the present disclosure, a shooting simulation device for pneumatic guns is provided. The device includes a housing having a proximal end attachable to or formed integrally with an end of a barrel of a pneumatic gun, a piston having a head and a shaft, the head being slidable within the proximal end of the housing between a ready position and a firing position, and the shaft configured to extend into the end of the barrel of the pneumatic gun, an illuminator in the housing, and an input device in the housing for activating the illuminator in response to the movement of the piston into the firing position. The illuminator may direct light, such as infrared light, out of a distal end of the housing and along a longitudinal axis of at least one of the housing or the barrel.

The head of the piston has a first outer diameter, and the shaft of the piston has a second outer diameter, wherein the first outer diameter may be greater than the second outer diameter. The head of the piston may also have a distal surface including a protrusion for engaging the input device.

In some embodiments, the housing includes at least one exhaust hole configured to release gas from when the head of the piston is in the firing position. The head of the piston may be proximal to the at least one exhaust hole when the piston is in the ready position, and the head of the piston may be at least partially distal to the at least one exhaust hole when the piston is in the firing position. In some embodiments, the device further includes a biasing element positioned between the head of the piston and the input device biasing the piston toward the ready position. The biasing element may be a spring, such as a conical spring.

The illuminator and input device may be housed together in an illumination cartridge removably retained in the housing. The device may further include a retainer attached to a distal end of the housing to retain the illumination cartridge in the housing.

In some embodiments, the shaft of the piston includes a plurality of elongated grooves extending along an exterior of the piston. In some embodiments, the shaft of the piston is hollow and includes at least one gas outlet adjacent to the head of the piston.

Further provided is a pneumatic gun, including a barrel, a housing at an end of the barrel, a piston having a head and a shaft, the head being slidable within a proximal end of the housing between a ready position and a firing position, and the shaft extending into the end of the barrel, an illuminator in the housing, and an input device for activating the illuminator in response to the head of the piston moving into the firing position.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

The present disclosure may be understood more readily by reference to the following detailed description of the disclosure taken in connection with the accompanying drawing figures, which form a part of this disclosure. It is to be understood that this disclosure is not limited to the specific devices, methods, conditions, or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

Figure 1:
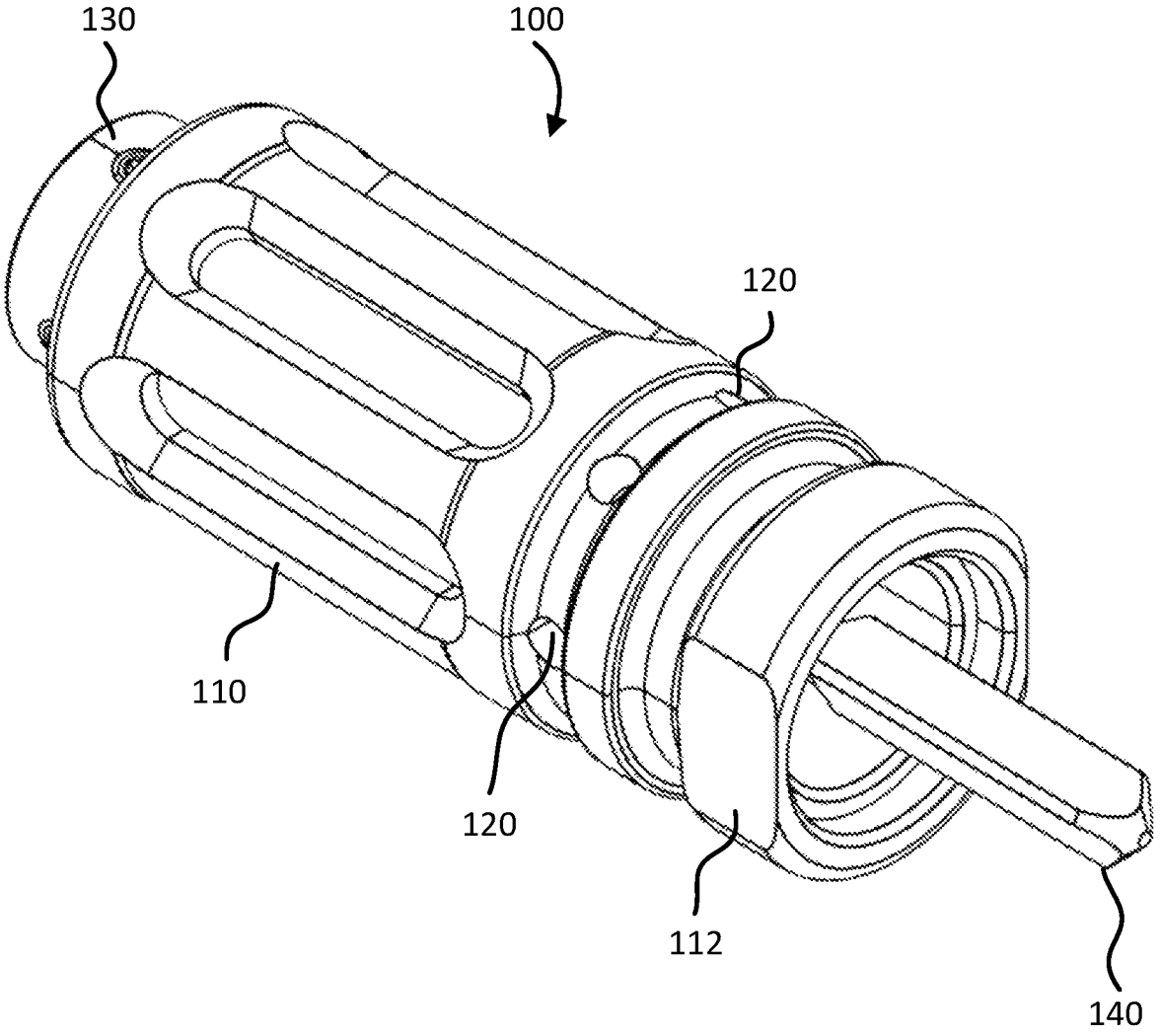
FIG. 1 is an isometric view of a shooting simulation device according to an exemplary embodiment of the present disclosure.
Figure 2:
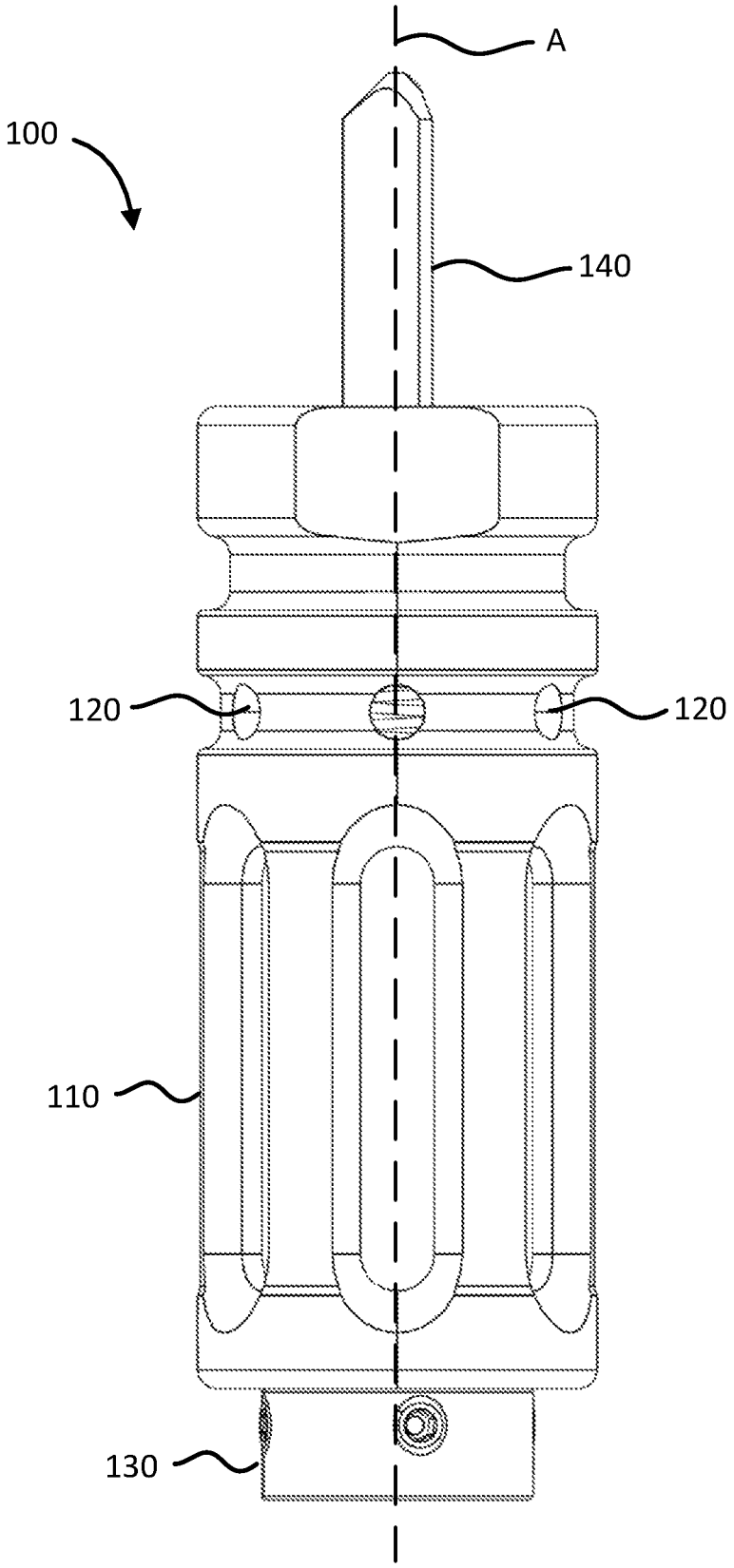
FIG. 2 is a side view of the device shown in FIG. 1.

FIGS. 1 and 2 show isometric and side views, respectively, of a shooting simulation device 100 according to an exemplary embodiment of the present disclosure. The device 100 includes a housing 110 including an interior channel defining a central axis A. The housing 110 may include an inlet portion 112 for receiving and/or attaching to a barrel of a gun. In some embodiments, the housing 110 is formed integrally with the barrel of the gun. A retainer 130 is engaged at least partially within the interior channel of the housing 110 at a distal end of the housing 110. The housing 110 further includes at least one exhaust hole 120 for releasing gas from the barrel to the atmosphere after the gun is fired. A piston 140 is slidably engaged in a proximal end of the housing 110 and movable along the central axis A.

Figure 3:
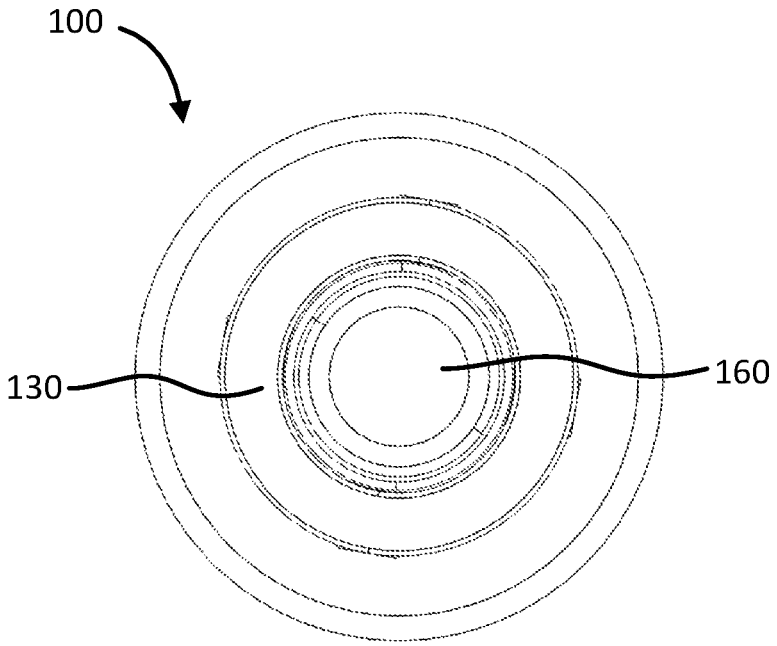
FIG. 3 is a distal end view of the device shown in FIG. 1.
Figure 4:
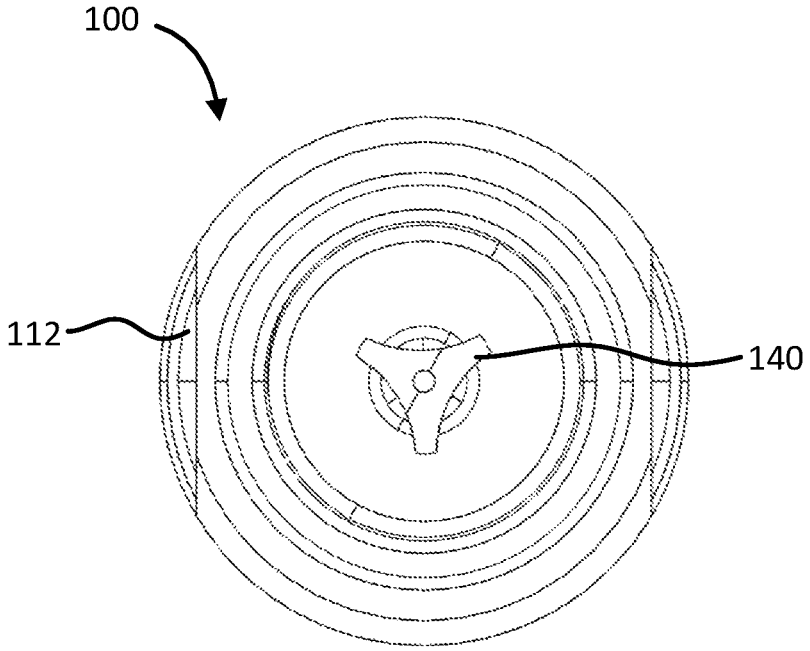
FIG. 4 is a proximal end view of the device shown in FIG. 1.

FIG. 3 shows the distal end of the device 100. The retainer 130 is configured to engage with and retain an illumination cartridge, such as an illumination cartridge 160 including an illuminator, in the device 100. In some embodiments, the retainer 130 and illumination cartridge 160 may be formed together as a single unit. In some embodiments, the housing 110 and the retainer 130 and illumination cartridge 160 may be formed together as a single unit. An illuminator of the illumination cartridge 160 may be activated to emit a beam of at least one wavelength of visible and/or invisible illumination along or parallel to the central axis A of the device 100 and/or a central axis of a barrel of a gun and/or a central axis of the aiming sights of a gun. FIG. 4 shows the proximal end of the device 100 with the piston 140 in place. As discussed in more detail below, the illumination cartridge 160 is activated by the piston 140 being moved in the longitudinal direction by gas from a gun barrel.

Figure 5A:
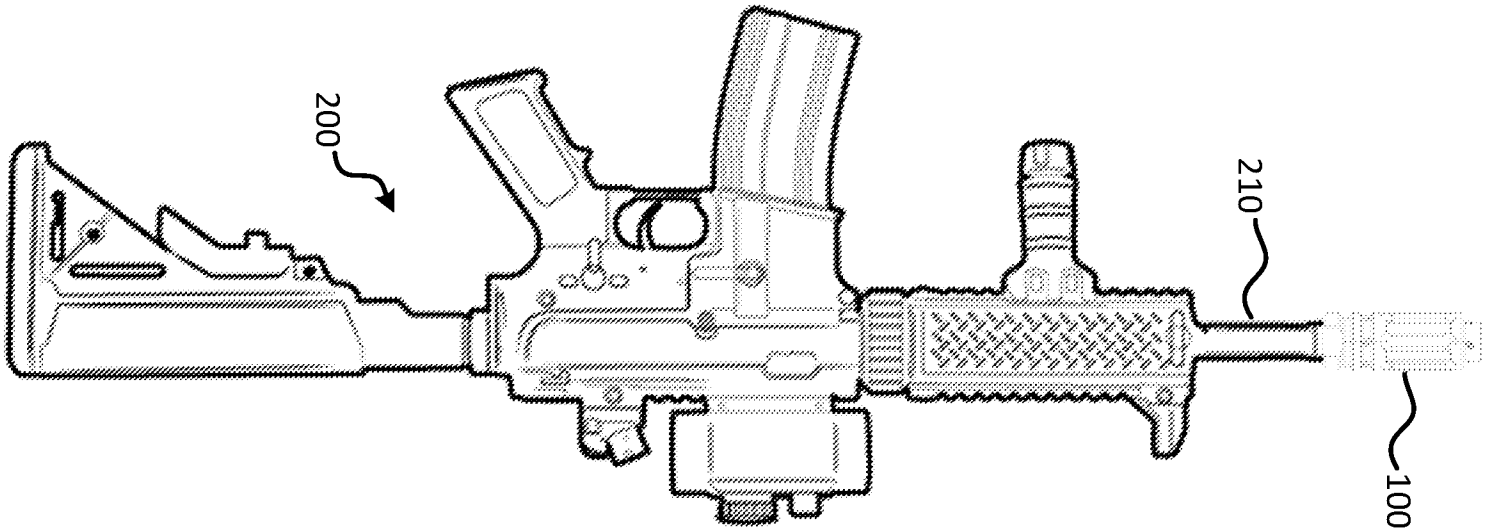
FIG. 5A is a side view of an exemplary pneumatic gun having a shooting simulation device according to an exemplary embodiment of the present disclosure attached thereto.
Figure 5B:
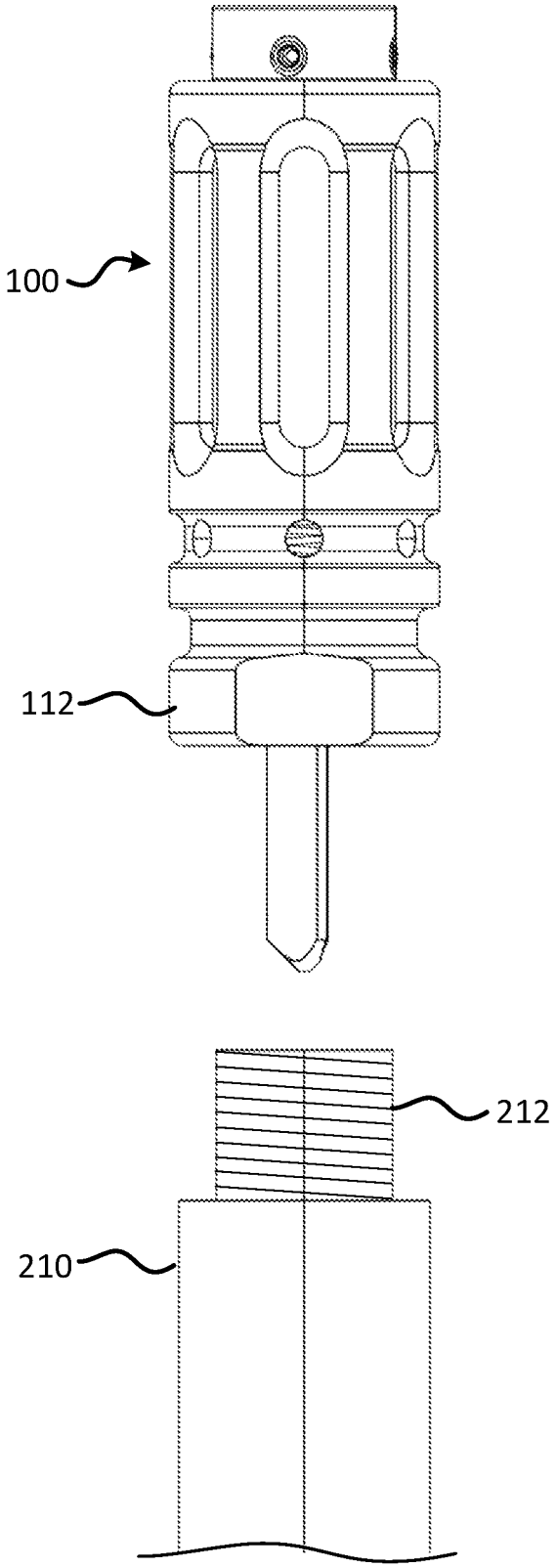
FIG. 5B is an exploded partial view of a barrel of the pneumatic gun and the device shown in FIG. 5A.

The device 100 may be adapted to attach to and work with various different types of pneumatic guns, including long guns and handguns. FIG. 5A shows a gun 200 with the device 100 attached thereto. The gun 200 is only exemplary and not intended to limit the scope or application of the invention. FIG. 5B shows an exploded view of a barrel 210 of the gun 200 and the device 100. In the exemplary embodiment, the barrel 210 has a distal end 212 with an attachment element which engages with a corresponding attachment element in the inlet portion 112 of the device 100. For example, the distal end 212 of the barrel 210 and the inlet portion 112 of the device 100 may threadably engage. Other means of attachment known in the art may also be used. Alternatively, the device 100 may be formed integrally with the barrel 210.

Figure 6A:
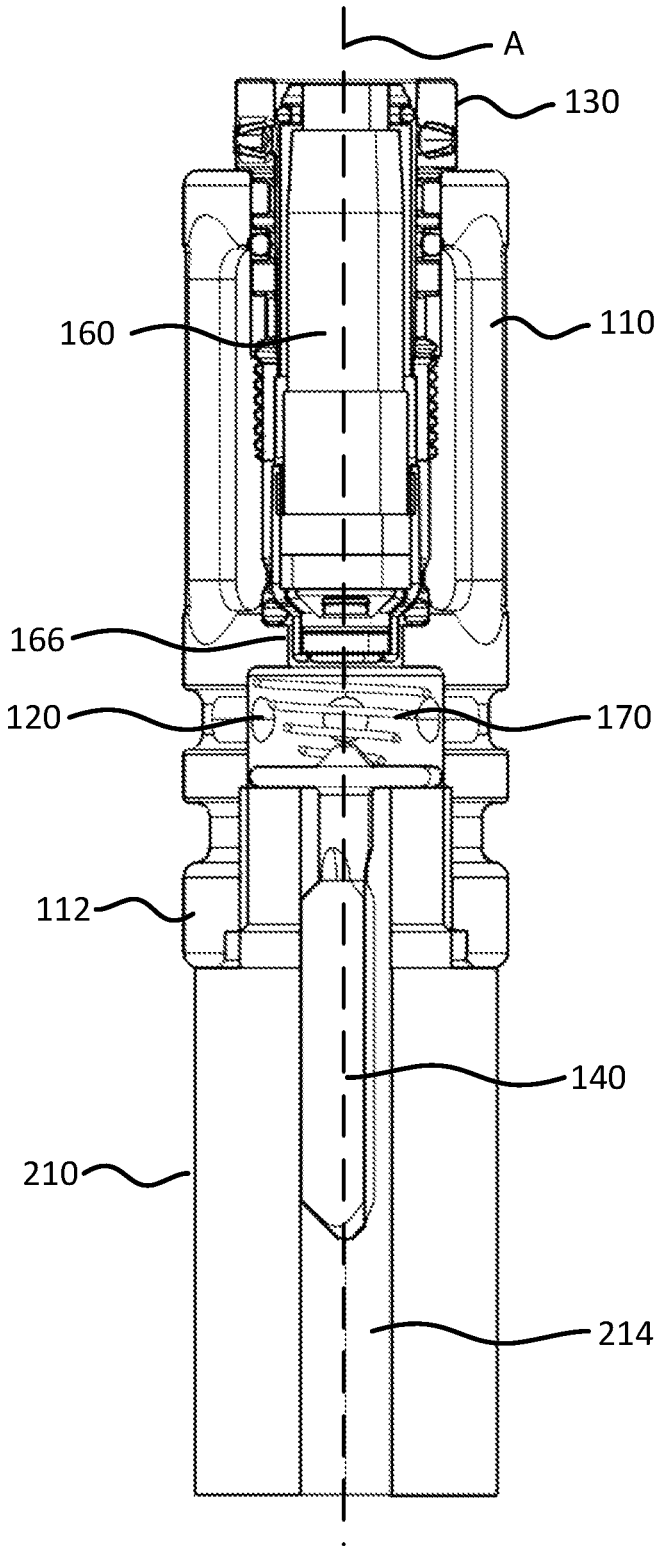
FIG. 6A is a sectional view of a shooting simulation device according to an exemplary embodiment of the present disclosure attached to a barrel of a pneumatic gun with a piston of the device in a ready position.

FIG. 6A shows a first sectional view of the device 100 and barrel 210. The barrel 210 has a central channel 214. A shaft of the piston 140 is sized to fit at least partially within the central channel 214 of the barrel 210. In a ready position shown in FIG. 6A, the piston 140 is biased away from the illumination cartridge 160 by a biasing element 170 such as a spring. The head of the piston 140 is behind (i.e., proximal to) the exhaust holes 120. When the gun 200 is fired (e.g., by pulling a trigger), pressurized gas is released down the central channel 214 of the barrel 210. As discussed in more detail below, the piston 140 is shaped to permit gas to travel along side of or within the piston 140 towards the distal end of the barrel 210 and against the head of the piston 140. The gas pressurizes behind the head of the piston 140 to move the piston forward along the central axis A towards the illumination cartridge 160.

Figure 6B:
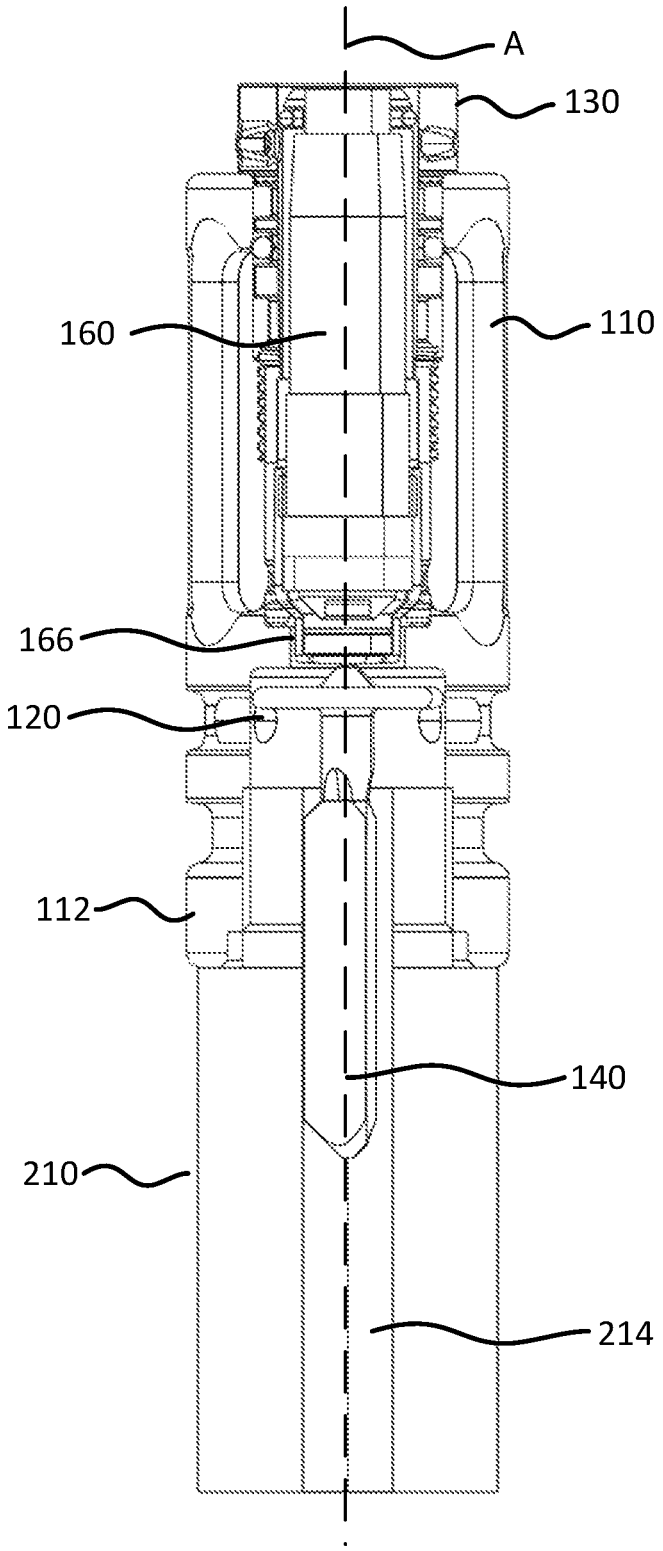
FIG. 6B is a sectional view of the device of FIG. 6A with the piston of the device in a firing position.

FIG. 6B shows a second sectional view of the device 100 and barrel 210. In FIG. 6B, the piston 140 is in a firing position having been moved forward by pressurized gas expelled by the gun 200. The piston 140 compresses the biasing element 170 (not shown in FIG. 6B) and moves toward (i.e., approaches) and/or impacts an input device 166 of the illumination cartridge 160 to activate the illumination cartridge 160. In some embodiments, the input device 166 may be operated by one of, but is not limited to, the following: vibration, mechanical displacement, electrical contact, magnetic sensor, optical proximity sensor. The central axis A of the housing 110 preferably aligns with a central axis of the barrel 210. Activation of the illumination cartridge 160 by the piston 140 results in light being transmitted approximately parallel to the central axis A, simulating the trajectory and/or hitting point of a projectile being fired from the gun 200. As the head of the piston 140 moves past the exhaust holes 120 in the housing 110, the pressurized gas is released via the exhaust holes 120. The piston 140 is then returned to the ready position by the biasing element 170.

Figure 7:
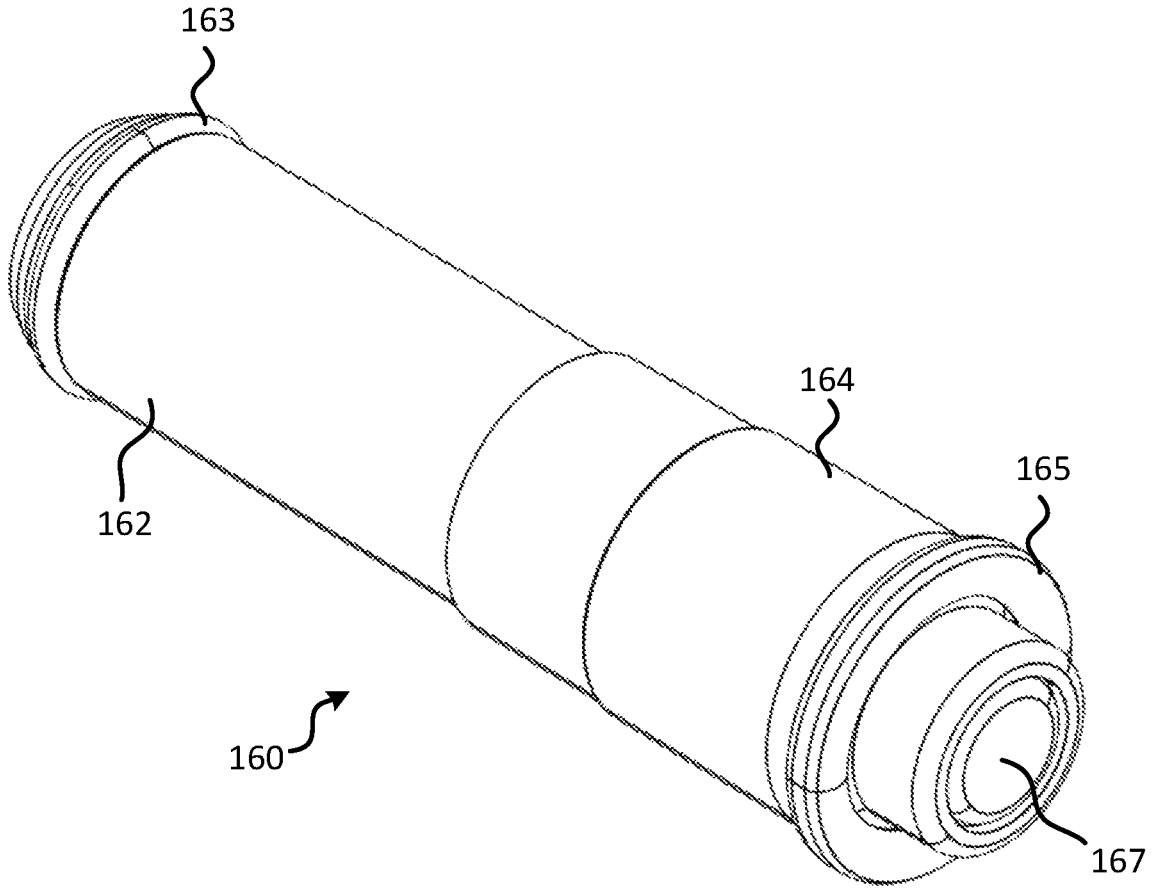
FIG. 7 is an isometric view of an illumination cartridge of a shooting simulation device according to an exemplary embodiment of the present disclosure.

FIG. 7 shows an illumination cartridge 160 according to an exemplary embodiment of the present disclosure. As discussed above, the illumination cartridge 160 is removably retained within the housing 110 by the retainer 130. The illumination cartridge 160 includes a first housing portion 162 and a second housing portion 164. The illumination cartridge 160 may have a plurality of O-rings 163, 165. The input device 166 may include a firing pad 167 is positioned at a proximal end of the illumination cartridge 160.

Figure 8:
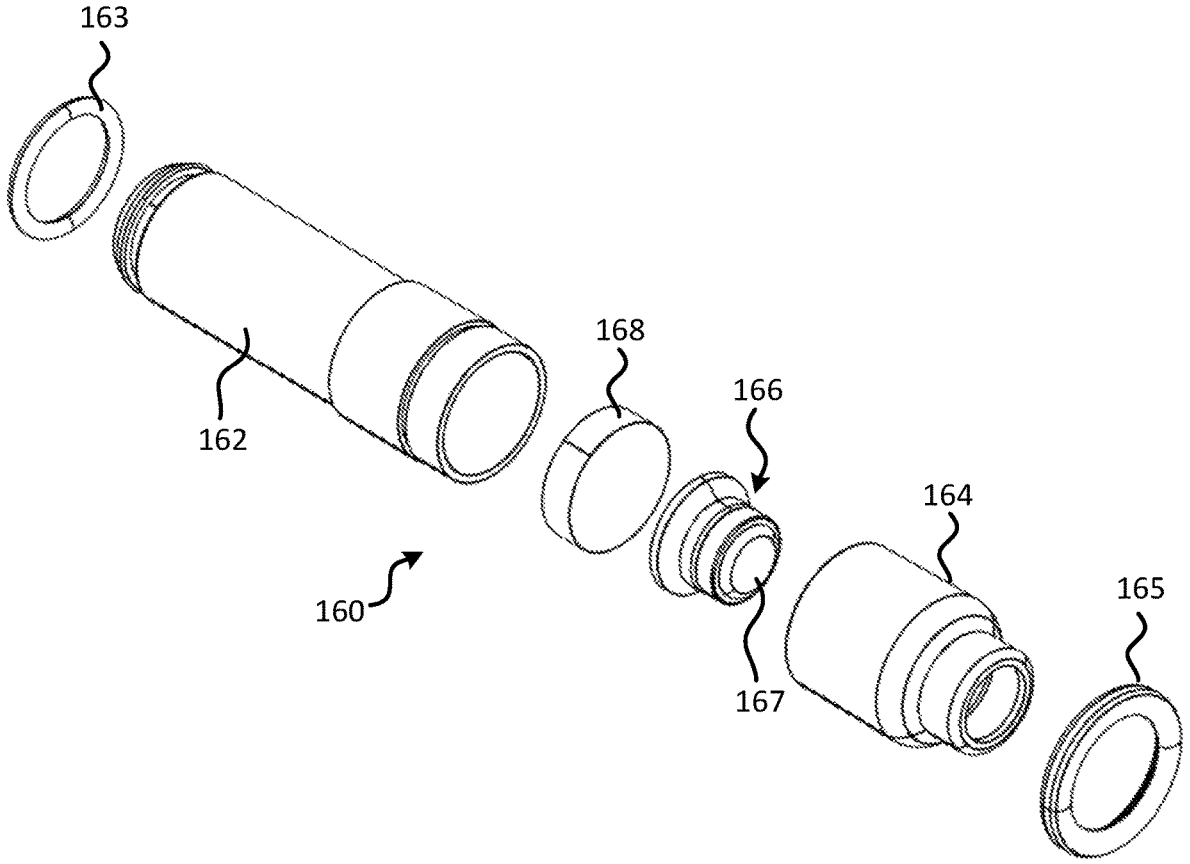
FIG. 8 is a partial exploded view of the illumination cartridge shown in FIG. 7.
Figure 9:
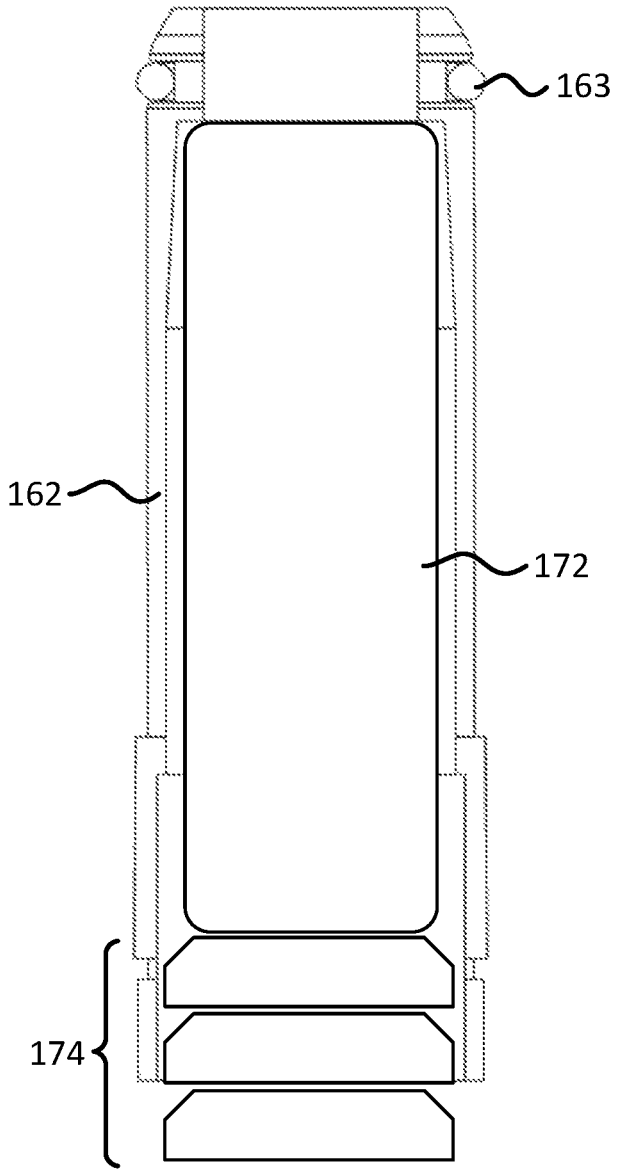
FIG. 9 is a sectional view of a first housing portion of the illumination cartridge shown in FIG. 7.

FIG. 8 is a partial exploded view of the illumination cartridge 160. The input device 166 may be housed at least partially within the second housing portion 164 and may extend at least partially out a proximal opening. Adjacent to the input device 166 is an electronic circuit 168. When the piston 140 moves into the firing position, the input device 166 creates an indication recognizable by the electronic circuit 168. In some embodiments, the input device 166 and electronic circuit 168 may be formed together as a single unit. An illuminator is positioned within the first housing portion 162. The illumination cartridge 160 also includes a power source, such as one or a plurality of batteries. The illuminator and power source are not shown in FIG. 8 for purposes of clarity. However, FIG. 9 is a sectional view of the first housing portion 162 of the cartridge 160 showing how an illuminator 172 and power source 174 may be positioned therein. FIG. 9 is only exemplary and not intended to limit the type or configuration of the illuminator 172 and/or power supply 174.

The illuminator 172 may emit an infrared (IR) light toward a desired target, however, exemplary embodiments of the present invention are not limited thereto. For example, illuminator 172 may emit visible light, ultraviolet (UV) light or any other type of desired optical signal and/or optical shape, such as any optical signal communicating with a training system configured to detect such an optical signal. For example, a particular simulative fire training system or target may be configured to identify, and the illuminator 172 may be configured to emit, one or more of different wavelengths of light, such as 635 nm light, 650 nm light, 780 nm light, 808 nm light, 850 nm light, 880 nm light, 905 nm light 940 nm light, and/or 980 nm light. However, exemplary embodiments of the present invention are not limited thereto, and the illuminator 172 may emit light of any desired wavelength, and of any desired firing pattern, including any desired combination of light wavelengths, or pulse, or frequencies or patterns.

The illumination cartridge 160 is only exemplary. For example, cartridges such as those disclosed in the following commonly-owned patents may be used: U.S. Pat. Nos. 8,568,143; 8,584,587; 8,734,156; and 10,563,948, each of which is incorporated herein by reference. The illuminator 172 and input device 166 may also be secured directly in the housing 110 without a cartridge. The illuminator 172 and input device 166 may also be secured directly into the barrel 210, e.g., in guns intended for training or gaming only.

Figure 10:
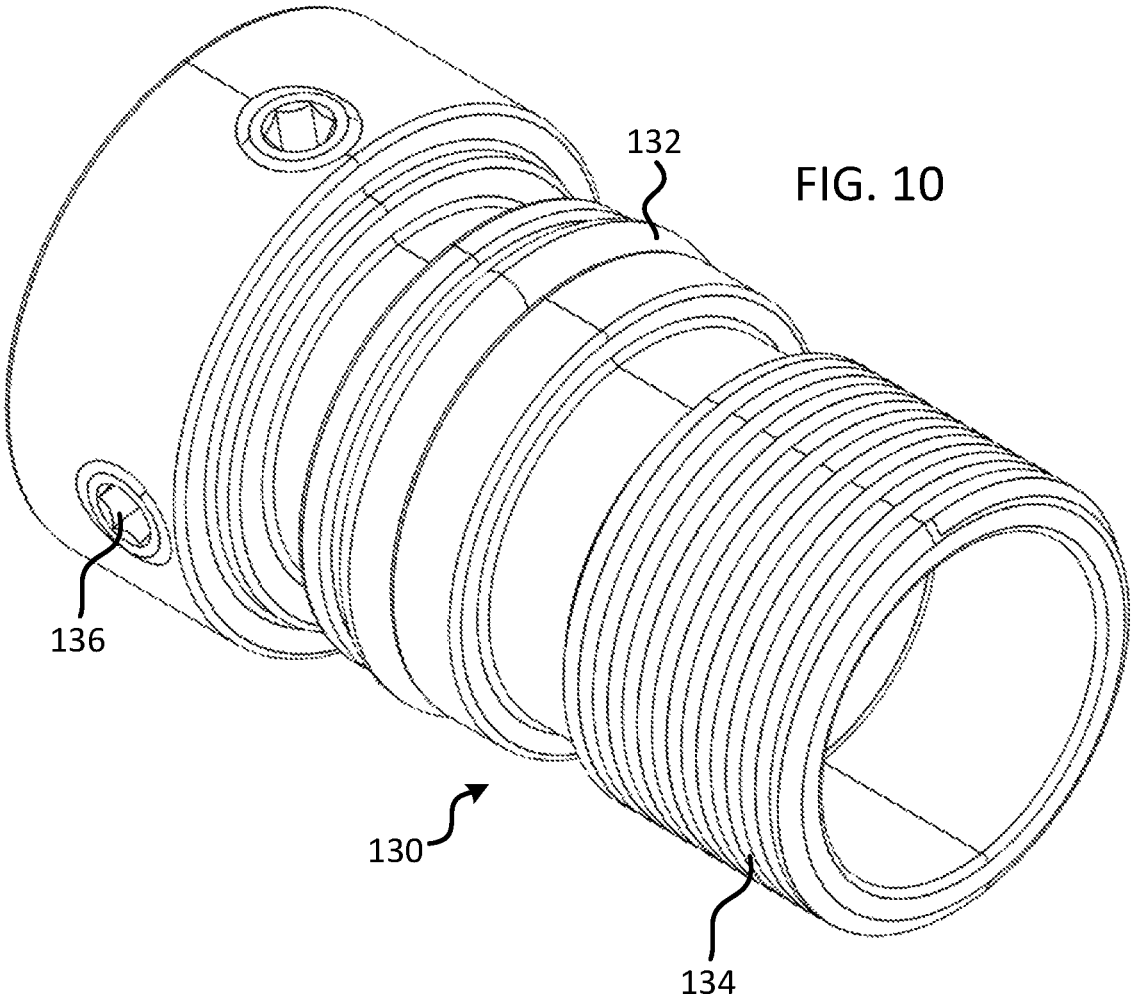
FIG. 10 is an isometric view of a retainer for an illumination cartridge of a shooting simulation device according to an exemplary embodiment of the present disclosure.

FIG. 10 shows a retainer 130 of the device 100. The retainer 130 is configured to slide into an end of the housing 110. As such, the retainer 130 has an outer diameter along at least part of its length that is less than an inner diameter of the housing 110. The retainer 130 may have one or more O-rings 132 to create a seal and/or friction with the housing 110. A proximal end of the retainer 130 includes an attachment element 134, such as threads, to engage a corresponding attachment element within the housing 110. The retainer 130 may also include a plurality of fasteners 136 to secure and/or allow alignment adjustment of the illumination cartridge 160 in the retainer 130.

Figure 11:
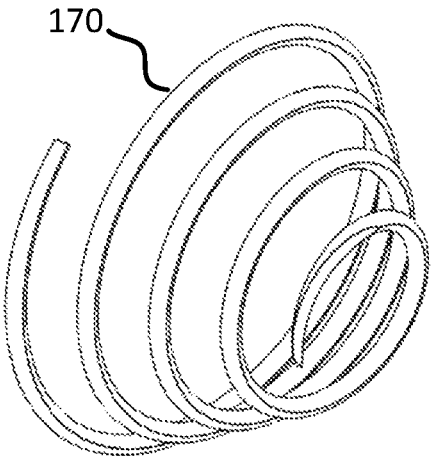
FIG. 11 is an isometric view of a biasing element of a shooting simulation device according to an exemplary embodiment of the present disclosure.

FIG. 11 shows an exemplary biasing element 170 in the form of a conical spring that may be positioned between the head of the piston 140 and the input device 166 of the illumination cartridge 160. The biasing element 170 biases the piston 140 toward the ready position and returns the piston 140 to the ready position after a firing position.

Figure 12:
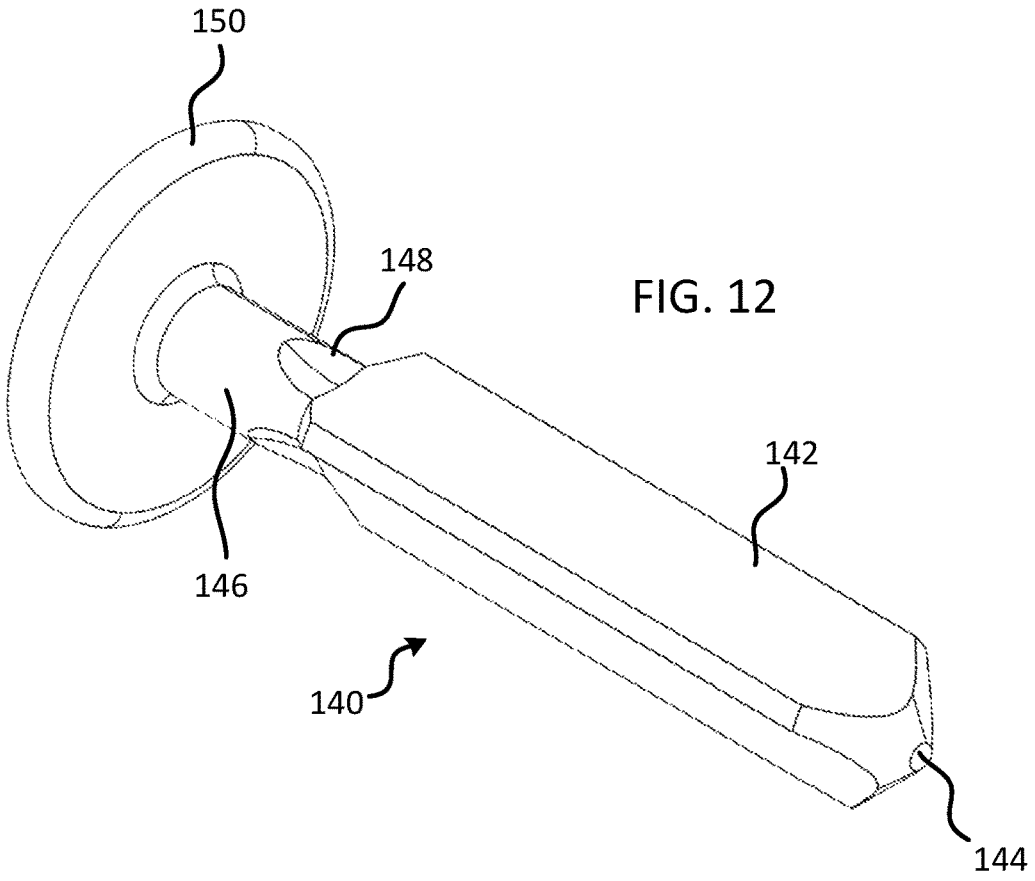
FIG. 12 is an isometric view of a piston of a shooting simulation device according to an exemplary embodiment of the present disclosure.
Figure 13:
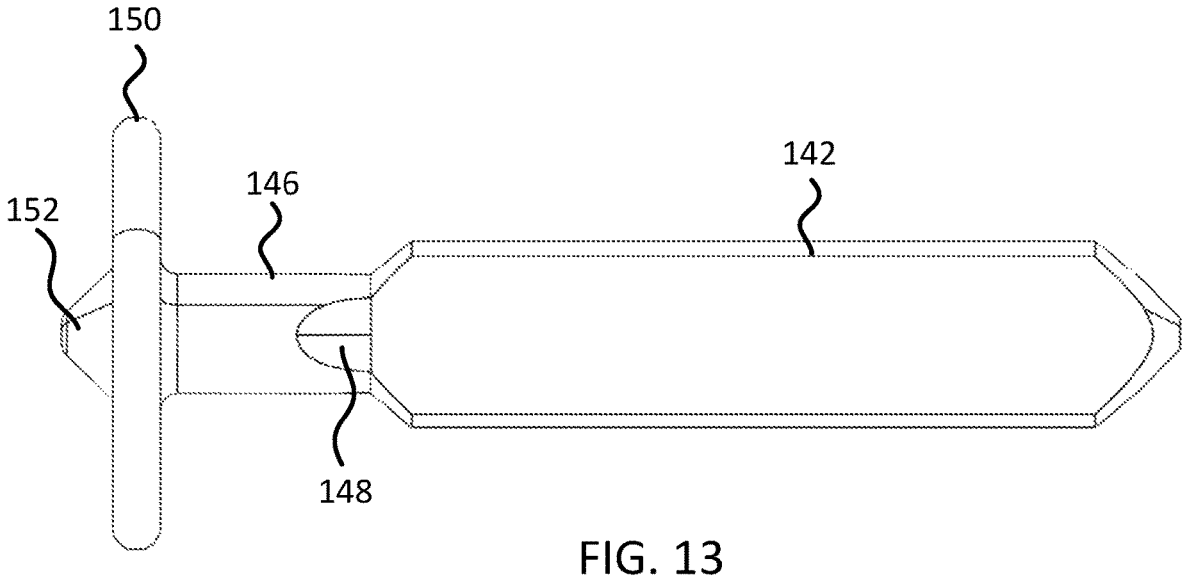
FIG. 13 is a side view of the piston shown in FIG. 12.

FIGS. 12 and 13 show a piston 140 according to an exemplary embodiment of the present disclosure. The piston 140 includes a shaft 142, 146 extending between a proximal end 144 and a head 150 of the piston 140. In the present example, the shaft 142, 146 includes a first section 142 with a plurality of (e.g., three) longitudinal grooves along the exterior of the shaft 142, 146. Sidewalls of the first section 142, which define the grooves, slide against or adjacent to an inner surface of the central channel 214 of the barrel 210 while the grooves define channels for airflow. The sidewalls of the grooves define an outer diameter of the shaft 142, 146 that is close to but less than an inner diameter of the central channel 214 of the barrel 210, or any barrel for which it is intended to be used. For example, for an Airsoft gun having a 6 mm barrel, the outer diameter may be about 5.9 mm.

A second section 146 of the shaft extends between the first section 142 and the head 150. The second section 146 may have a substantially circular cross-section and may have bevels 148 to direct gas (e.g., $CO_2$) against a proximal surface of the head 150. In other embodiments, the sidewalls and grooves extend to the proximal surface of the head 150. The head 150 may include a protrusion 152 on a distal surface. The protrusion 152 and/or head 150 may include one of, but is not limited to, impact resistant, conductive, magnetic, or reflective materials, for engaging with the input device 166 and/or firing pad 167.

For example, when the gun is fired (e.g., by pulling a trigger), pressurized gas is released down the central channel 214 of the barrel 210 and travels along the grooves of the piston 140 to apply pressure to and translate the piston 140 forward. The protrusion 152, which in this example is made of an impact resistant material, hits firing pad 167 to engage the input device 166, which in this example contains a pressure activated switch, to activate the illumination cartridge 160. The gas is then expelled through the exhaust holes 120 of the housing 110, which releases pressure and allows the piston 140 to return to the ready position (e.g., with the assistance of the biasing element 170).

Figure 14:
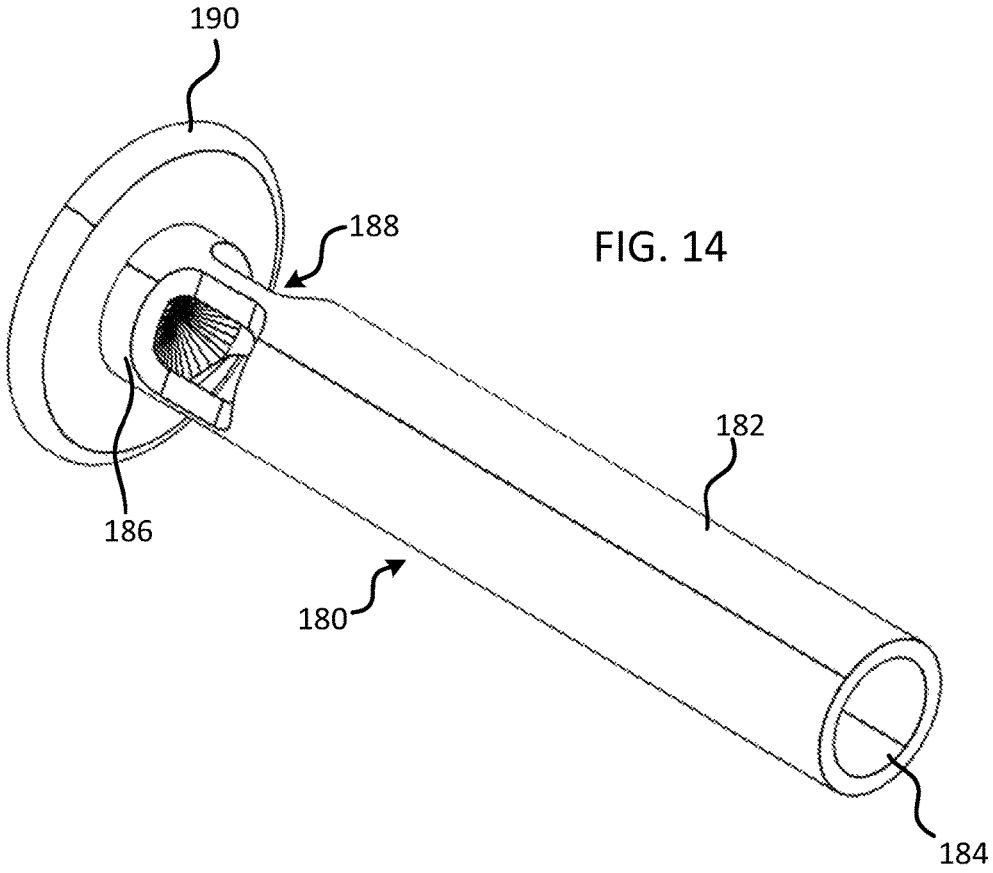
FIG. 14 is an isometric view of a piston of a shooting simulation device according to an exemplary embodiment of the present disclosure.
Figure 15:
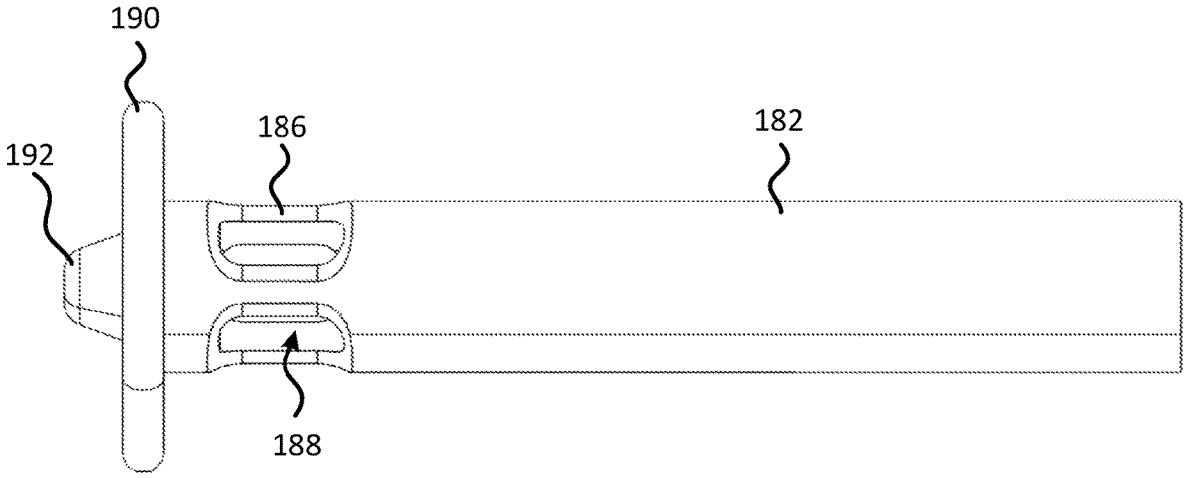
FIG. 15 is a side view of the piston shown in FIG. 14.

FIGS. 14 and 15 show a piston 180 according to an exemplary embodiment of the present disclosure. The piston 180 includes a shaft 182, 186 extending between a proximal end 184 and of the piston 180 and a head 190 of the piston 140. In the present example, the shaft 182, 186 includes a first section 182 that is tubular. The exterior surface of the first section 182 slides along or adjacent to an inner surface of the central channel 214 of the barrel 210 while the hollow interior defines channels for airflow. The first section 182 may have an outer diameter that is close to but less than an inner diameter of the barrel of the gun for which it is intended to be used. For example, for an Airsoft gun having a 6 mm barrel, the outer diameter may be about 5.9 mm. In an exemplary embodiment, the first section 182 has an inner diameter of about 4.5 mm.

A second section 186 of the shaft extends between the first section 182 and the head 190. The second section 186 includes a plurality of (e.g., three) outlets 188 to release gas (e.g., $CO_2$) from the hollow interior of the first section 182. When the piston 180 is in the ready position and receives pressurized gas from the barrel 210, the gas is directed down the hollow interior and against an end of the hollow interior to move the piston 180. A distal end of the hollow interior may be concave to collect the gas. As the piston 180 moves forward and enters the firing position, the outlets 188 become exposed within the housing 110. Gas is released out of hollow interior, into the housing 110, and out of the exhaust holes 120 to the atmosphere. The head 190 may include a protrusion 192 on a distal surface. The protrusion 192 and/or head 190 may include one of, but not limited to, impact resistant, conductive, magnetic, or reflective materials, for engaging with the input device 166 and/or firing pad 167.

For example, when the gun is fired (e.g., by pulling a trigger), pressurized gas is released down the central channel 214 of the barrel 210 and applies pressure to translate the piston 190 forward. The protrusion 192 of the piston 190, which in this example contains a magnet which creates a magnetic field, approaches input device 166, which in this example contains a sensor such as a 'hall effect' to detect the change in the magnetic field and engages the input device 166 to activate the illumination cartridge 160. The gas is then expelled through the exhaust holes 120 of the housing 110, which releases pressure and allows the piston 140 to return to the ready position (e.g., with the assistance of the biasing element 170).

According to another example, the protrusion 192 of the piston 190, which in this example is made of a conductive material, while in firing position is pressed against input device 166, which in this example contains exposed conductive electrical leads creating a momentary electrical connection between the leads to engages the input device 166 to activate the illumination cartridge 160.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A shooting simulation device for pneumatic guns, comprising:

a housing having a proximal end attachable to or formed integrally with an end of a barrel of a gun;

a piston having a head and a shaft, the head being slidable within the proximal end of the housing between a ready position and a firing position, and the shaft configured to extend into the end of the barrel of the gun;

an illuminator in the housing; and an input device in the housing for activating the illuminator in response to the head of the piston moving into the firing position.

2. The device of claim 1, wherein the illuminator directs infrared light out of a distal end of the housing and along a longitudinal axis of at least one of the housing or the barrel.

3. The device of claim 1, wherein the housing includes at least one exhaust hole configured to release gas from when the head of the piston is in the firing position.

4. The device of claim 3, wherein the head of the piston is proximal to the at least one exhaust hole when the piston is in the ready position, and wherein the head of the piston is at least partially distal to the at least one exhaust hole when the piston is in the firing position.

5. The device of claim 1, further comprising a biasing element positioned between the head of the piston and the input device biasing the piston toward the ready position.

6. The device of claim 5, wherein the biasing element is a spring.

7. The device of claim 1, further comprising an illumination cartridge including the illuminator and the input device, the illumination cartridge removably retained in the housing.

8. The device of claim 7, further comprising a retainer attached to a distal end of the housing, the retainer retaining the illumination cartridge in the housing.

9. The device of claim 1, wherein the shaft of the piston includes a plurality of elongated grooves extending along an exterior of the piston.

10. The device of claim 1, wherein the shaft of the piston is hollow and includes at least one gas outlet adjacent to the head of the piston.

11. The device of claim 1, wherein the proximal end of the housing includes a first attachment element adapted to engage a second attachment element on the end of the barrel of the gun.

12. The device of claim 11, wherein the first and second attachment elements are threads.

13. The device of claim 1, wherein the head of the piston has a first outer diameter, and the shaft of the piston has a second outer diameter, the first outer diameter being greater than the second outer diameter.

14. The device of claim 1, wherein the head of the piston has a distal surface including a protrusion for impacting a firing pad of the input device.

15. A pneumatic gun, comprising:

a barrel;

a housing at an end of the barrel;

a piston having a head and a shaft, the head being slidable within a proximal end of the housing between a ready position and a firing position, and the shaft extending into the end of the barrel;

an illuminator in the housing; and an input device for activating the illuminator in response to the head of the piston moving into the firing position.

16. The pneumatic gun of claim 15, wherein the illuminator directs infrared light out of a distal end of the housing and along a longitudinal axis of the barrel.

17. The pneumatic gun of claim 15, wherein the housing is removably attachable to the end of the barrel.

18. The pneumatic gun of claim 15, wherein the housing includes at least one exhaust hole, wherein the head of the piston is proximal to the at least one exhaust hole when the piston is in the ready position and at least partially distal to the at least one exhaust hole when the piston is in the firing position.

19. The pneumatic gun of claim 15, further comprising a biasing element between the head of the piston and the input device biasing the piston toward the ready position.

20. The pneumatic gun of claim 15, wherein the head of the piston has a distal surface including a protrusion for impacting a firing pad of the input device.

* * * * *